United States Patent [19]
Jäger et al.
[11] 4,221,019
[45] Sep. 9, 1980

[54] FLOORCARE DEVICE

[75] Inventors: Jurgen Jäger, Witten; Georg Haase, Radevormwald, both of Fed. Rep. of Germany

[73] Assignee: Vorwerk & Co Interhaolding GmbH, Wuppertal, Fed. Rep. of Germany

[21] Appl. No.: 31,868

[22] Filed: Apr. 20, 1979

[30] Foreign Application Priority Data

Apr. 20, 1978 [DE] Fed. Rep. of Germany ..... 2817197

[51] Int. Cl.[3] ..... A47L 9/06

[52] U.S. Cl. ..... 15/368; 15/41 R; 15/392

[58] Field of Search ..... 15/368, 392, 355, 372, 15/41 R

[56] References Cited

U.S. PATENT DOCUMENTS

| | | | |
|---|---|---|---|
| 1,081,340 | 12/1913 | Spangler | 15/355 |
| 1,483,972 | 2/1924 | Hoover | 15/368 |
| 2,712,669 | 7/1955 | Frere et al. | 15/368 |
| 3,671,996 | 6/1972 | Gaudry | 15/368 |
| 3,959,847 | 6/1976 | Kaulig et al. | 15/368 |

*Primary Examiner*—Christopher K. Moore
*Attorney, Agent, or Firm*—Michael J. Striker

[57] ABSTRACT

A floorcare device has a round brush located in a housing and rotatable about a rigid axle. At least one axial end portion of the axle is supported in the housing by an eccentric, so that by turning the eccentric the height of the axle and thereby of the round brush relative to the housing can be varied. Turning of the eccentric is performed by a ratchet mechanism. Another such eccentric may support the other end of the axle. The ratchet mechanism may include two ratchet wheels each provided on a respective one of the eccentrics, and two rings surrounding the ratchet wheels and having inner ratchets engageable with the latter.

13 Claims, 5 Drawing Figures

FLOORCARE DEVICE

BACKGROUND OF THE INVENTION

The present invention relates to a floorcare device which operates with the use of suction. More particularly, it relates to a floorcare device which is formed as a suction nozzle to be fitted on a suction conduit.

Floorcare devices of this general type are known in the art. A known floorcare device formed as a suction nozzle has a round brush which has a hollow body and rotates about a rigid axle on bearings with the aid of a power drive. The portions of the axle are supported in a housing of the device by eccentrics. Each of the eccentrics has a cylindrical receiving portion in which a respective end portion of the axle is received, and an engaging portion which is eccentrically offset relative to the receiving portion. The height of the round brush relative to a housing of the device, in other words, relative to a floor to be cleaned, can be adjusted. In the known device, this adjustment is performed by varying the eccentricity of the axle about which the round brush rotates. For this purpose, the engaging portion of one of the eccentrics is provided with a slot. A user must insert an additional instrument (at most such as a coin) into this slot and turn the engaging portion. Owing to the rigid connection between the axle and the engaging portions of both eccentrics, the engaging portion of the other eccentric also turns. Since the engaging portions are located eccentrically relative to the receiving portions, the rigid axle is either raised or lowered. Thereby, the position of an axis of rotation of the round brush is also changed relative to the housing or to the floor. This construction is disclosed in the German patent application P 2 318 425.0.

The above-described device has a disadvantage that the slot which is formed in the part constituted of a synthetic plastic material is destroyed after some time. A further disadvantage of this device is that when an additional tool, such as a coin, is utilized, a housewife must apply considerably high force for turning the engaging portion of the eccentric.

SUMMARY OF THE INVENTION

Accordingly, it is an object of the present invention to provide a floorcare device which avoids the disadvantages of the prior art.

More particularly, it is an object of the present invention to provide a floorcare device which permits a user to perform height adjustments easily and simply, as well as without an additional tool.

In keeping with these objects and with others which will become apparent hereinafter, one feature of the present invention resides, briefly stated, in a floorcare device wherein a rigid axle of a round brush is supported in a housing by an eccentric which can be turned by a ratchet mechanism. In such a construction the eccentric and thereby the axle can be easily and simply turned by a user so as to adjust the height of the round brush.

In accordance with another feature of the present invention, two such eccentrics are provided, and the rachet mechanism is formed by two ratchet wheel each provided on a respective one of the eccentrics, and two ring surrounding the ratchet wheels and having ratchets engageable with the ratchet wheels.

The ratchet of each ratchet ring may be elastic and of one piece with the latter. One of the rings may be mounted in the housing immovably, whereas the other ring is turnable and provided with a lever for turning the same. The adjustment of the brush height can be performed by a user with the aid of the lever, without utilization of an additional tool. The adusting lever may be pulled to the housing by a spring which returns the lever to its initial position. Finally, a further feature of the present invention is that an engaging portion of each eccentric may be formed as the above-mentioned ratchet wheel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
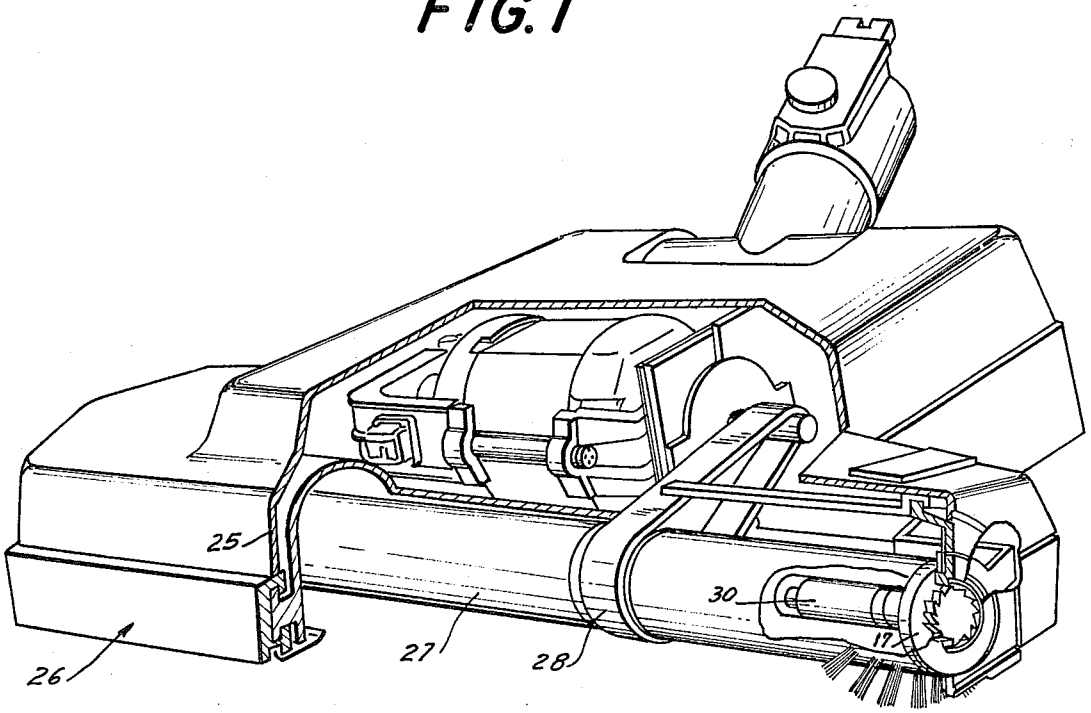
FIG. 1 is a perspective view of a floorcare device formed as a suction nozzle, in which a part of a housing is removed so as to show a round brush.

A floorcare machine in accordance with the present invention is shown in FIG. 1. It is formed as a power sweeper which can be fitted onto a conventional suction unit.

A round brush 27 of the power sweeper is mounted in a housing 25 near its front longitudinal wall 26. The round brush 27 is driven in rotation by a belt drive 28. The round brush is supported at its both axial ends in receiving elements 23 and 24 of side walls 4 and 5 of the housing 25, as can be seen particularly from FIG. 2. The round brush 27 has a hollow body part 1. An axle 16 of the round brush 27 extends through the hollow interior of the body part 1 and is connected with two eccentrics 18 and 17 at both axial ends of the axle. The axle 16 together with the eccentrics 17 and 18 define an axis of rotation of the round brush 27. Bearing 30 are interposed between the axle 16 and the body part 1 at the round brush 27.

The eccentrics 17 and 18 located at opposite axial sides of the axle 16 are identical. Each eccentric has a receiving portion 31 and an engaging portion 19. One axial end portion of the axle 16 is received in the receiving portion 31 of the eccentric 17, whereas another axial end portion of the axle 16 is received in the receiving portion 31 of the eccentric 18. The axial end portions of the axle 16 are arrested in the receiving portions 31 of the eccentrics 17 and 18.

The engaging portions 19 of the eccentrics 17 and 18 are formed as ratchet wheels 47 and 48, respectively. The engaging portion 19 of the eccentric 18, which is formed as the ratchet wheel 48, is shown particularly in FIG. 4. The ratchet wheel 47 forming the engaging portion 19 of the eccentric 17, is identical to the ratchet wheel 48. The ratchet wheels 47 and 48 have a plurality of teeth 55. The teeth 55 of the ratchet wheels 47 and 48 are inclined in opposite circumferential directions, if viewed at the side of the receiving portion of each eccentric. Thereby, when the eccentrics 17 and 18 are mounted on the axle 16, the ratchet wheels 47 and 48 with their teeth 55 are mirror-symmetrical relative to one another.

Figure 3:
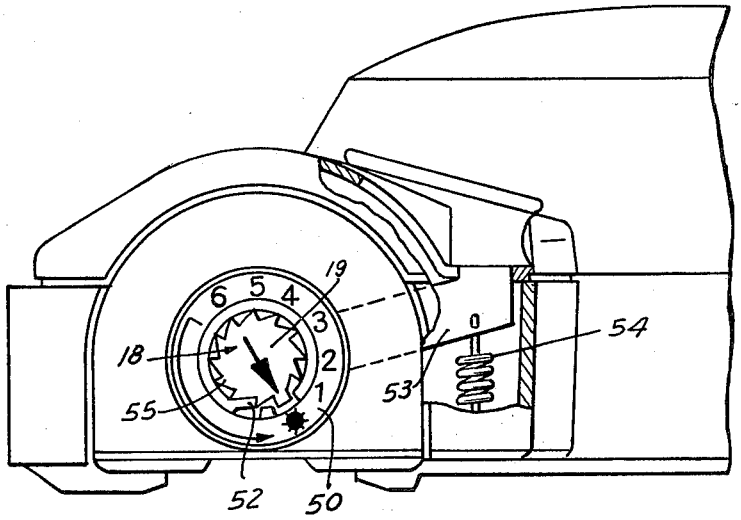
FIG. 3 is a side view of the floorcare device in accordance with the present invention.

Two rings 49 and 50 are further provided. The ring 49 is mounted immovably and surrounds the ratchet wheel 47. The ring 50 is turnable and surrounds the ratchet wheel 48. The rings 49 and 50 are identical with the exception of an adjusting lever 53 which is provided on the ring 50. The ring 50 with the lever 53 is more clearly shown in FIG. 5. With the aid of the adjusting lever 53, the turnable ring 50 can be turned in a circumstantial direction. As shown in FIG. 3, the adjusting lever 53 is pulled toward an immovable part of the housing by a tension spring 54. The adjusting lever 53 extends outwardly beyond the housing of the device.

Figure 4:
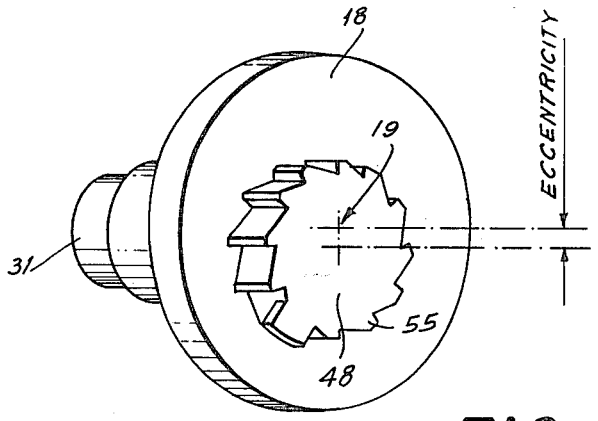
FIG. 4 is a perspective view showing an eccentric arranged at one end of an axle about which the round brush rotates.

The engaging portions 19 which are formed as ratchet wheels 47 and 48 are radially offset relative to the receiving portions 31 of the eccentrics 17 and 18. This is shown in FIG. 4 for the eccentric 18. A geometrical axis of the ratchet wheel 48 is offset relative to a geometrical axis of the receiving portion 31 so as an eccentricity is formed therebetween. The same is true for the eccentric 17 in which the geometrical axes of the ratchet wheel 47 and the receiving portion 31 are offset relative to one another so as to form an identical eccentricity.

Figure 5:
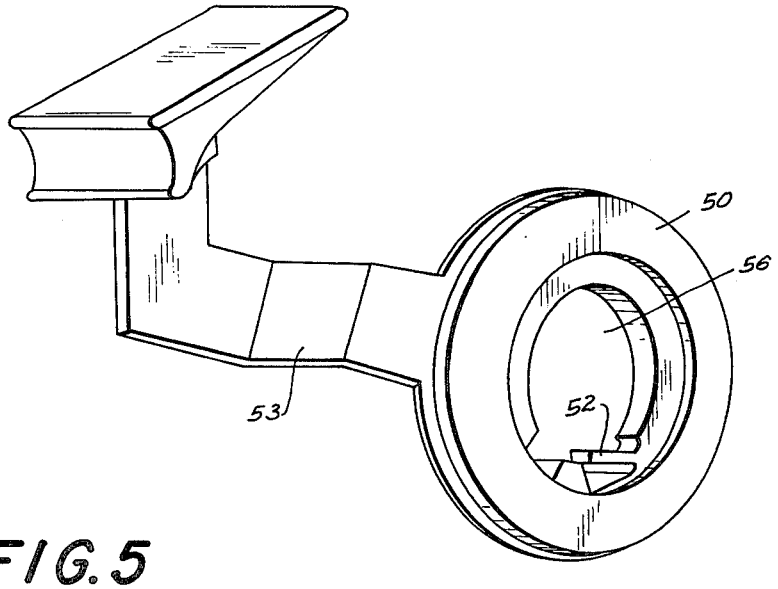
FIG. 5 is a perspective view of a ring member arranged at one end of the axle and cooperating with one of the eccentrics so as to form together a ratchet mechanism.

Each of the rings has an inner opening 56 bounded by an inner wall, as shown in FIG. 5 for the ring 50 surrounding the eccentric 18. A ratchet 52 is formed on the inner wall of the ring 50. The ratchet 52 is elastic and of one piece with the ring 50. The ring 49 which surrounds the eccentric 17 also has a ratchet 52 identical to that shown in FIG. 5.

Figure 2:
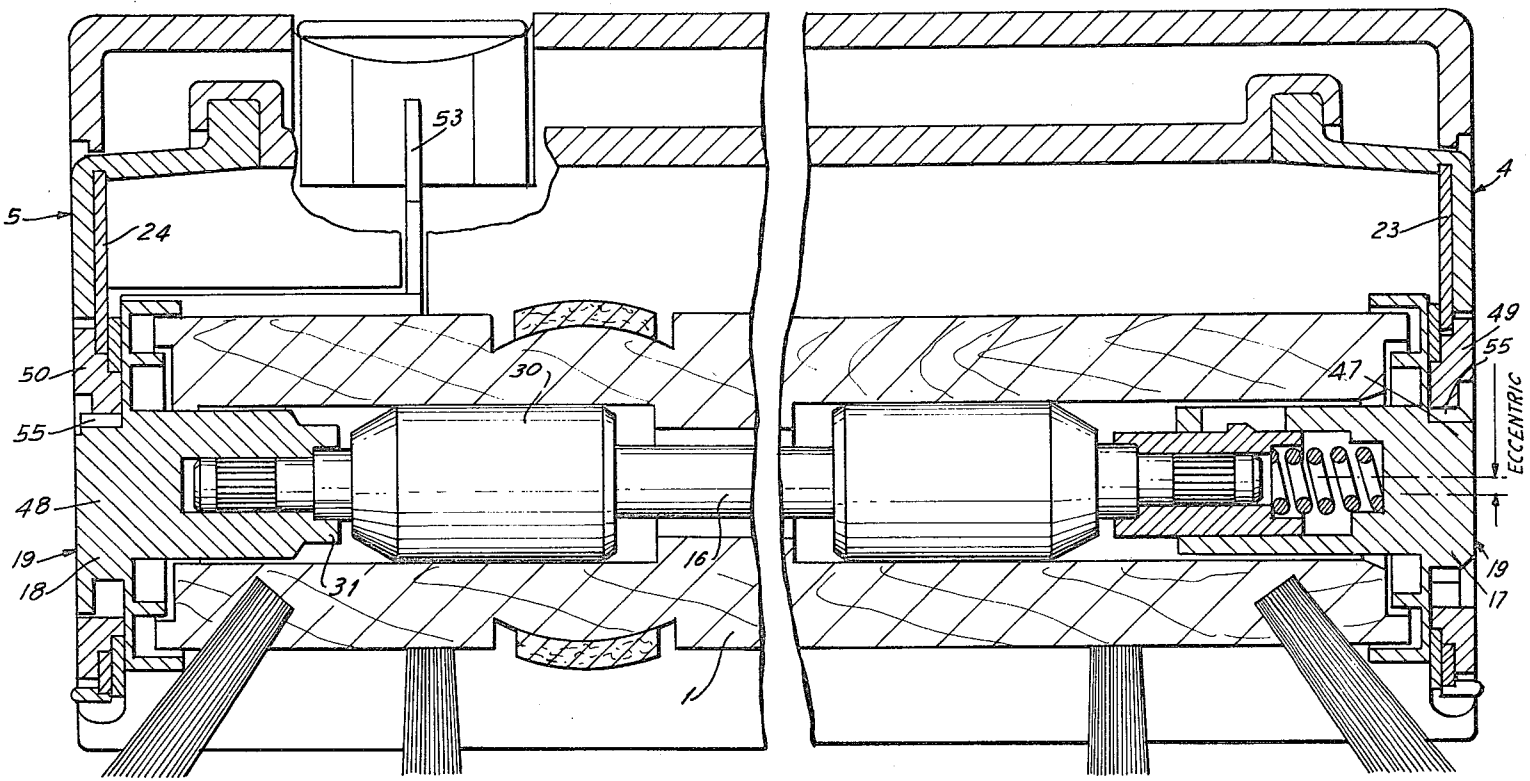
FIG. 2 is a partially sectioned front view of the device in enlarged scale.

The ratchet wheel 48 with the teeth 55, and the ring 50 surrounding the same and having the ratchet 52, together form one part of a ratchet mechanism at one side of the axle 16, that is at the left side as seen in FIG. 2. The ratchet wheel 47 with the teeth 55, and the ring 49 surrounding the same and having the ratchet 52, together form another part of the ratchet mechanism at the other side of the axle 16, that is at the right side as seen in FIG. 2. The parts or the ratchet mechanism are almost identical and mirror-symmetrical, with the exception of the lever 53 provided on the left ring 50, and the fact that the left eccentric 18 carrying the left ratchet wheel 48 is turnable, whereas the right eccentric 17 carrying the right ratchet wheel 47 is immovable.

Adjustment of the height of the round brush 27 relative to the housing or the device and thereby relative to a floor is performed in the following manner. When the lever 53 is, for example, lifted, the ring 50 located at the left end of the axle 16 turns counter-clockwise in FIG. 3. The ratchet 52 of the left ring 50 presses against one tooth 55 of the ratchet wheel 48 and thereby turns the eccentric 18 counter-clockwise. The eccentric 18 is fixedly connected with the axle 16 which, in turn, is fixedly connected with the eccentric 17. Therefore, when the eccentric 18 turns counter-clockwise, the axle 16 and the eccentric 17 also turn counter-clockwise. The ratchet wheel 47 of the eccentric 17 also turns. However, the ring 49 which surrounds the ratchet wheel 47 does not turn, inasmuch as it is immovably mounted in the housing. When the adjustment lever is released, it is pulled to its initial position by the spring 53. Since the eccentricity is provided between the geometrical axes of the ratchet wheels 47 and 48, on the one hand, and the receiving portions 31, on the other hand, the body of the round brush 27 is either raised or lowered, in dependence upon the direction of circumferential displacement of the adjusting lever 53.

It will be understood that each of the elements described above, or two or more together, may also find a useful application in other types of constructions differing from the types described above.

While the invention has been illustrated and described as embodied in a floor-care device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A floorcar device operable with the use of suction, comprisng a housing;

a hollow brush in said housing, said hollow brush bounding an inner passage and rotatable about an axis;

an axle extending through said inner passage of said hollow brush and defining the axis of rotation thereof, said axle having two axial end portions;

two eccentrics, each respective one of which being located adjacent to a respective one of said axial end portions of said axle and having a receiving portion which is coaxial with said axis of rotation and receives a respective one of said axial end portions of said brush, and an engaging portion which has a further axis spaced from said axis of rotation so that said engaging portion is eccentrically offset relative to said receiving portion of the same eccentric; and a ratchet mechanism turnably supporting said engaging portion of said eccentrics and thereby supporting said axle and said hollow brush in said housing, and arranged to turn said eccentrics about said further axis of said engaging portions so that said receiving portions and thereby said axle and said axis of rotation of said hollow brush are displaced relative to said housing whereby the position of said axis of rotation of said hollow brush relative to said housing can be adjusted, said ratchet mechanism including a corresponding ratchet wheel on the engaging portion of each one of said eccentrics, and a corresponding ring member mounted in said housing surrounding each one of said ratchet wheels and having a ratchet engageable with the latter.

2. A floorcare device as defined in claim 1, wherein said housing is formed as a suction nozzle arranged to communicate with a suction source.

3. A floorcare device as defined in claim 1, and further comprising drive means, and a power transmission connecting said drive means with said hollow brush so as to rotate the latter about said axis.

4. A floorcare device as defined in claim 1, wherein said receiving portion of said eccentrics are cylindrical.

5. A floorcare device as defined in claim 1, and further comprising at least one bearing interposed between said axle and said brush.

6. A device as defined in claim 1, wherein said ratchet wheels have a plurality of teeth, the teeth of one of said ratchet wheels being inclined in a first circumferential direction, whereas the teeth of the other wheel are inclined in a second circumferential direction which is opposite to said first circumferential direction, so that in assembled condition said ratchet wheels are mirror-symmetrical relative to one another.

7. A device as defined in claim 1, wherein said ratchets of said rings are elastic.

8. A device as defined in claim 7, wherein each of said ratchets are of one piece with a respective one of said rings.

9. A device as defined in claim 1, wherein one of said ring members is turnably mounted in said housing; and further comprising an adjusting lever connected with said one ring member and arranged to be turned by a user so as to turn said one ring member and the ratchet wheel of the corresponding eccentric.

10. A device as defined in claim 9, wherein said adjusting lever extends outwardly beyond said housing so as to be readily accessible for a user.

11. A device as defined in claim 9; and further comprising spring means for returning said lever to its initial position after turning said lever by a user.

12. A device as defined in claim 11, wherein said spring means includes a tension spring which is connected between said adjusting lever and said housing so as to pull the former to the latter.

13. A device as defined in claim 1, wherein the ratchet wheel of each eccentric is formed by the engaging portion of the same eccentric.

* * * * *